US009962942B2

(12) United States Patent
Kanemoto

(10) Patent No.: US 9,962,942 B2
(45) Date of Patent: May 8, 2018

(54) PRINTING APPARATUS

(71) Applicant: SEIKO EPSON CORPORATION, Tokyo (JP)

(72) Inventor: Shuichi Kanemoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/408,497

(22) Filed: Jan. 18, 2017

(65) Prior Publication Data

US 2017/0217193 A1 Aug. 3, 2017

(30) Foreign Application Priority Data

Jan. 29, 2016 (JP) ..... 2016-015311

(51) Int. Cl.
*B41J 29/17* (2006.01)
*B41J 2/165* (2006.01)

(52) U.S. Cl.
CPC ..... *B41J 2/16552* (2013.01); *B41J 29/17* (2013.01)

(58) Field of Classification Search
CPC ..... B41J 2/16552; B41J 2002/16558; B41J 29/17; B41J 11/007; B41J 13/08; B41J 15/048; B65G 45/18; B65G 45/10; B65G 45/22; B65G 45/24; B65G 39/073
See application file for complete search history.

(56) References Cited

U.S. PATENT DOCUMENTS

2008/0107461 A1* 5/2008 Miyata ..... B41J 11/007 399/343
2013/0195528 A1 8/2013 Noguchi et al.
2013/0278693 A1* 10/2013 Bellisario ..... B41J 29/17 347/104
2014/0198161 A1* 7/2014 Kanemoto ..... B41J 29/17 347/101

FOREIGN PATENT DOCUMENTS

EP 0579433 A1 1/1994
EP 2756958 A2 7/2014
EP 2923849 A1 * 9/2015 ..... B41J 15/048
JP 06-240589 A 8/1994
JP 2010-190999 A 9/2010
JP 2012116617 A * 6/2012 ..... B41J 11/007
JP 5569366 B2 8/2014
JP 2015-182849 A 10/2015

OTHER PUBLICATIONS

Agatsuma et al., MachineTranslationofJP 2012116617 A, 2012.*
The partial European Search Report for the corresponding European Application No. 17153618.8 dated Apr. 19, 2017.
The extended European Search Report for the corresponding European Application No. 17153618.8 dated Jun. 20, 2017.

* cited by examiner

*Primary Examiner* — Geoffrey Mruk
*Assistant Examiner* — Scott A Richmond

(57) ABSTRACT

A printing apparatus includes a transport belt which transports a printing medium in a transport direction; a cleaning tank which stores cleaning liquid; and a first cleaning roller and a second cleaning roller which are dipped in the cleaning liquid and are rotatably in contact with the transport belt. The first cleaning roller and the second cleaning roller include spiral brushes which generate water flow for directing the cleaning liquid in one direction by the rotation of the first cleaning roller and the second cleaning roller.

4 Claims, 9 Drawing Sheets

PRINTING APPARATUS

BACKGROUND

1. Technical Field

The present invention relates to a printing apparatus.

2. Related Art

In the related art, A printing apparatus is known which performs printing a pattern or the like on a surface of fabric such as cotton, silk, wool, chemical fiber, and blend. The printing apparatus which is used for printing includes a medium transport portion which mounts a printing medium on a transport belt which has an endless shape and has an adhesive and transports the printing medium in order to handle fabric which has elasticity as the printing medium. In the printing apparatus, it is necessary to perform cleaning of the transport belt since ink protruding from the printing medium when performing printing on an end portion of the printing medium, ink which has passed through the fabric, fiber which is dropped out of the fabric or the like is attached to the surface of the transport belt. Therefore, for example, in JP-A-6-240589, a printing machine (printing apparatus) which includes a cleaning tank encasing a roll brush is disclosed in order to clean an endless belt (transport belt).

In the printing apparatus in JP-A-6-240589, cleaning liquid may be contaminated by cleaned ink and thus cleaning ability of the transport belt may be decreased, in a case where the transport belt is cleaned for a long time with the cleaning roller being dipped in the cleaning liquid which is stored in the cleaning tank. In addition, the precipitated ink, fiber which is dropped out of fabric, and an adhesive which is peeled from the transport belt, or the like is accumulated in the cleaning tank. Productivity of the printing apparatus may be decreased by frequency of cleaning which removes these accumulated materials being increased.

SUMMARY

The invention can be realized in the following forms or application examples.

APPLICATION EXAMPLE 1

According to this application example, there is provided a printing apparatus including a transport belt which transports a printing medium in a transport direction; a cleaning tank which stores cleaning liquid; and a cleaning roller which is dipped in the cleaning liquid and is rotatably in contact with the transport belt. The cleaning roller includes a spiral brush which generates water flow for directing the cleaning liquid in one direction by the rotation of the cleaning roller.

According to the present application example, the printing apparatus includes the cleaning roller having the spiral brush. When the transport belt is cleaned by the cleaning roller being rotated, water flow for directing the cleaning liquid in one direction is generated by the spiral brush. Cleaning liquid in which ink is melted, fiber which is dropped out of fabric as a printing medium, or an adhesive which is peeled from the transport belt is likely to discharged to an outside of the cleaning tank along with the cleaning liquid. Accordingly, cleaning ability of the transport belt is improved by the cleaning liquid being purified. In addition, since accumulated material by foreign material which is remained, ink which is precipitated in the cleaning tank, or the like is reduced, frequency of cleaning which removes the accumulated material and which is performed after the printing apparatus is stopped is reduced and thus operating time of the printing apparatus is longer. Therefore, the printing apparatus can be provided which improves the cleaning ability of the transport belt and production efficiency of the apparatus.

APPLICATION EXAMPLE 2

In the printing apparatus according to this application example, it is preferable that the cleaning tank include a supplying port which supplies the cleaning liquid and a discharging port which discharges the cleaning liquid and the water flow direct the cleaning liquid from the supplying port to the direction of the discharging port.

According to the application example, the cleaning tank includes the supplying port which supplies the cleaning liquid and the discharging port which discharges the cleaning liquid. The water flow for directing the cleaning liquid from the supplying port to the direction of the discharging port can be generated by the cleaning roller in which the brush wound in a spiral shape is included being rotated. Accordingly, the cleaning liquid in which ink is melted, fiber which is dropped out of fabric, or an adhesive which is peeled from the transport belt is likely to discharged to the outside of the cleaning tank along with the cleaning liquid. Accordingly, cleaning ability of the transport belt is improved by the cleaning liquid being purified. In addition, since accumulated material such as foreign material which is remained or ink which is precipitated in the cleaning tank is reduced, frequency of cleaning which removes the accumulated material can be reduced. In addition, the accumulated material can be easily discharged from the discharging port since the accumulated material is accumulated in the vicinity of the discharging port.

APPLICATION EXAMPLE 3

It is preferable that the printing apparatus according to this application example include a plurality of cleaning rollers.

According to the application example, momentum of the water flow for directing the cleaning liquid in one direction can be increased since a cleaning portion includes the plurality of cleaning rollers.

APPLICATION EXAMPLE 4

In the printing apparatus according to this application example, it is preferable that at least one of the plurality of cleaning rollers have a different winding direction of the brush and a different rotating direction of the cleaning roller.

According to the application example, at least one cleaning roller of the plurality of cleaning rollers has a different winding direction of the brush and a different rotating direction of the cleaning roller from the other cleaning roller. Accordingly, the transport belt can be suitably cleaned by the plurality of cleaning rollers of which the rotating directions are different from each other while the water flow of the cleaning liquid is kept in one direction.

APPLICATION EXAMPLE 5

In the printing apparatus according to this application example, it is preferable that at least one of the plurality of cleaning rollers have a dense winding density of the brush.

According to the application example, at least one cleaning roller of the plurality of cleaning rollers has a dense winding density of the brush. Accordingly, the cleaning ability which cleans the transport belt can be improved since a contact surface between the brush and the transport belt with each other is wider.

APPLICATION EXAMPLE 6

In the printing apparatus according to this application example, it is preferable that at least one of the plurality of cleaning rollers have a coarse winding density of the brush.

According to the application example, at least one cleaning roller of the plurality of cleaning rollers has a coarse winding density of the brush. Accordingly, cleaning ability of the transport belt can be further improved by momentum of the water flow for directing the cleaning liquid in one direction is increased and thus cleaning liquid is further purified.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described, with reference to drawings. Scales of each layer and each member are different from those of actual layers and actual members since each layer and each member have recognizable extent of sizes in the following drawings.

In addition, X axis, Y axis, and Z axis are illustrated as three axes which are perpendicular to each other for convenience of explanation in FIG. 1, and FIG. 3 to FIG. 9. A distal end side of an arrow which illustrates an axial direction is referred to as "+side" and a proximal end side thereof is referred to as "−side". In addition, a direction which is parallel to X axis is referred to as "X axis direction", a direction which is parallel to Y axis is referred to as "Y axis direction", and a direction which is parallel to Z axis is referred to as "Z axis direction", in the following.

Embodiment 1

Schematic Configuration of Printing Apparatus

Figure 1:
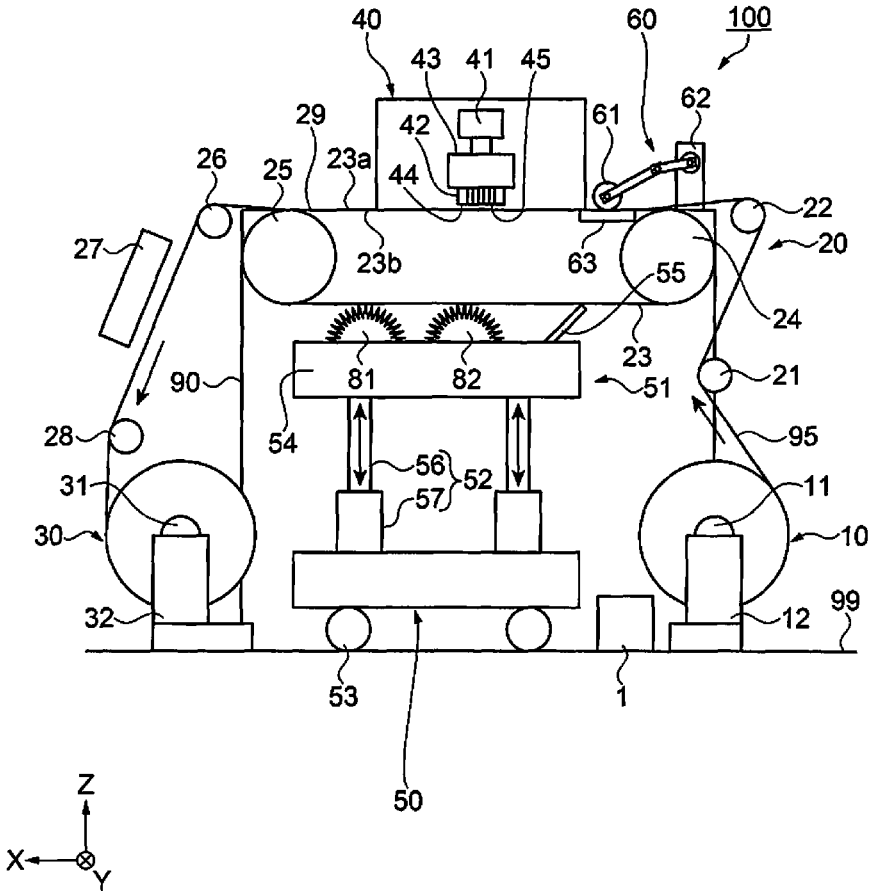
FIG. 1 is a schematic view illustrating overall configuration of a printing apparatus according to Embodiment 1.

FIG. 1 is a schematic view illustrating overall configuration of a printing apparatus according to Embodiment 1. First, with reference to FIG. 1, the schematic configuration of a printing apparatus 100 according to the embodiment will be described. In the embodiment, an ink jet type of the printing apparatus 100 which performs printing on a printing medium 95 by forming an image or the like on the printing medium 95 will be described.

As illustrated in FIG. 1, the printing apparatus 100 includes a medium transport portion 20, a medium close contacting portion 60, a printing portion 40, a drying unit 27, a cleaning unit 50, and the like. The printing apparatus 100 includes a control portion 1 which controls each portion described above. Each portion of the printing apparatus 100 is attached to a frame portion 90.

The medium transport portion 20 transports the printing medium 95 in a transport direction (+X axis direction in the printing portion 40). The medium transport portion 20 includes a medium supplying portion 10, transport rollers 21 and 22, a transport belt 23, a belt rotating roller 24, a belt driving roller 25, transport rollers 26 and 28, and a medium collecting portion 30. First, a transport path of the printing medium 95 leading from the medium supplying portion 10 to the medium collecting portion 30 will be described.

The medium supplying portion 10 supplies the printing medium 95 on which an image is formed to the printing portion 40 side. Fabric such as cotton, wool, and polyester is used as the printing medium 95, as an example. The medium supplying portion 10 includes a supplying shaft portion 11 and a bearing portion 12. The supplying shaft portion 11 has a cylindrical shape or a columnar shape and is provided to be rotatable in a circumferential direction. The printing medium 95 having a strip shape is wound into a roll shape in the supplying shaft portion 11. The supplying shaft portion 11 is detachably attached to the bearing portion 12. Therefore, the printing medium 95 in a state of being wound to the supplying shaft portion 11 in advance is capable of being attached to the bearing portion 12 along with the supplying shaft portion 11.

The bearing portion 12 supports to be rotatable both ends of the supplying shaft portion 11 in an axial direction. The medium supplying portion 10 includes a rotating/driving portion (not illustrated) which rotates and drives the supplying shaft portion 11. The rotating/driving portion rotates the supplying shaft portion 11 in a direction in which the printing medium 95 is delivered. An operation of the rotating/driving portion is controlled by the control portion 1. The transport rollers 21 and 22 relay the printing medium 95 from the medium supplying portion 10 to the transport belt 23.

The transport belt 23 transports the printing medium 95 in the transport direction (+X axial direction). Specifically, the transport belt 23 is formed in an endless shape by connecting both ends of a belt having a strip shape with each other and is hung on the belt rotating roller 24 and the belt driving roller 25. The transport belt 23 is held in a state where a predetermined tension is applied so that a portion between the belt rotating roller 24 and the belt driving roller 25 is parallel to a floor surface 99. An adhesive layer 29 which adheres the printing medium 95 is provided in a surface 23*a* (supporting surface) of the transport belt 23. The transport belt 23 supports (holds) the printing medium 95 which is supplied from the transport roller 22 and is in close contact with the medium close contacting portion 60 to be described below by the adhesive layer 29. Accordingly, fabric, or the like which has elasticity can be handled as the printing medium 95.

The belt rotating roller 24 and the belt driving roller 25 support an inner peripheral surface 23*b* of the transport belt 23. A supporting portion which supports the transport belt 23 is configured to be provided between the belt rotating roller 24 and the belt driving roller 25.

The belt driving roller 25 includes a motor (not illustrated) which rotates and drives the belt driving roller 25. When the belt driving roller 25 rotates and drives, the transport belt 23 rotates according to the rotation of the belt driving roller 25, and then the belt rotating roller 24 rotates by the rotation of the transport belt 23. The printing medium 95 which is supported on the transport belt 23 is transported in the predetermined transport direction (+X axial direction) by the rotation of the transport belt 23 and thus an image is formed on the printing medium 95 at the printing portion 40 to be described below.

In the embodiment, the printing medium 95 is supported on a side (+Z axis side) in which the surface 23*a* of the transport belt 23 faces the printing portion 40 and the printing medium 95 is transported from the belt rotating roller 24 side to the belt driving roller 25 side along with the transport belt 23. In addition, only the transport belt 23 moves from the belt driving roller 25 side to the belt rotating roller 24 side in a side (−Z axis side) in which the surface 23*a* of the transport belt 23 faces the cleaning unit 50. Although the transport belt 23 is described as being provided with the adhesive layer 29 which is in close contact with the printing medium 95, it is not limited to this. For example, a transport belt may be an electrostatic adsorption type of a transport belt which absorbs the medium to the belt by static electricity.

The transport roller 26 peels off the printing medium 95 on which an image is formed from the adhesive layer 29 of the transport belt 23. The transport rollers 26 and 28 relay the printing medium 95 from the transport belt 23 to the medium collecting portion 30.

The medium collecting portion 30 collects the printing medium 95 which is transported by the medium transport portion 20. The medium collecting portion 30 includes a winding shaft portion 31 and a bearing portion 32. The winding shaft portion 31 has a cylindrical shape or a columnar shape and is provided to be rotatable in a circumferential direction. The printing medium 95 having a strip shape is wound into a roll shape in the winding shaft portion 31. The winding shaft portion 31 is detachably attached to the bearing portion 32. Therefore, the printing medium 95 in a state of being wound to the winding shaft portion 31 is removed along with the winding shaft portion 31.

The bearing portion 32 supports to be rotatable both ends of the winding shaft portion 31 in an axial direction. The medium collecting portion 30 includes a rotating/driving portion (not illustrated) which rotates and drives the winding shaft portion 31. The rotating/driving portion rotates the winding shaft portion 31 in a direction in which the printing medium 95 is wound. An operation of the rotating/driving portion is controlled by the control portion 1.

Next, each portion which is provided along the medium transport portion 20 will be described.

The medium close contacting portion 60 is in close contact between the printing medium 95 and the transport belt 23 with each other. The medium close contacting portion 60 is provided in an upstream (−X axis side) of the printing portion 40. The medium close contacting portion 60 includes a pressing roller 61, a pressing roller driving portion 62 and a roller supporting portion 63. The pressing roller 61 has a cylindrical shape or a columnar shape and is provided to be rotatable in a circumferential direction. The pressing roller 61 is disposed to be intersected between an axial direction thereof and the transport direction with each other in order to rotate in a direction along the transport direction. The roller supporting portion 63 is provided in the inner peripheral surface 23*b* of the transport belt 23 in a state of facing the pressing roller 61 with the transport belt 23 being inserted between the pressing roller 61 and the roller supporting portion 63.

The pressing roller driving portion 62 moves the pressing roller 61 in the transport direction (+X axis direction) and in a direction (−X axis direction) opposite to the transport direction while pressing the pressing roller 61 in a lower side of the vertical direction (−Z axis side). The printing medium 95 which is overlapped with the transport belt 23 is pressed against the transport belt 23 between the pressing roller 61 and the roller supporting portion 63. Accordingly, the printing medium 95 can be reliably adhered to the adhesive layer 29 which is provided in the surface 23*a* of the transport belt 23 and can prevent the printing medium 95 from being lifted from the transport belt 23.

The printing portion 40 is disposed on the upper side (+Z axis side) with respect to a disposition position of the transport belt 23. The printing portion 40 includes the discharging head 42 which discharges ink or the like in a droplet shape on the printing medium 95 mounted on the transport belt 23, a carriage 43 on which the discharging head 42 is mounted, and a carriage moving portion 41 which moves the carriage 43 in a width direction (Y axis direction) of the printing medium 95 which is intersected with the transport direction. A nozzle plate 44 on which a plurality of nozzle rows 45 are formed is provided in the discharging head 42. For example, four nozzle rows 45 are formed on the nozzle plate 44. Ink having a different color (for example, cyan: C, magenta: M, yellow: Y, black: K) is discharged per each nozzle row 45. The nozzle plate 44 faces the printing medium 95 which is transported by the transport belt 23.

The carriage moving portion 41 moves the discharging head 42 in a direction (the width direction (Y axis direction) of the printing medium 95) which is intersected with the transport direction of the printing medium 95. The carriage 43 is configured to be supported on a guide rail (not illustrated) which is disposed along Y axis direction and to be capable of reciprocating in the ±Y axis direction by the carriage moving portion 41. Mechanism of a combination of a ball screw and a ball nut, a linear guide mechanism, or the like can be adapted as a mechanism of the carriage moving portion 41, for example.

Further, a motor (not illustrated) as a power source for moving the carriage 43 along Y axis direction is provided in the carriage moving portion 41. When the motor is driven by the control of the control portion 1, the discharging head 42 reciprocates along in the Y axis direction along with the carriage 43. As the discharging head 42, a serial-head type which discharges ink while moving in the width direction (±Y axis direction) of the printing medium 95 which is mounted on the movable carriage is included as an example in the embodiment. However, as the discharging head 42, a line-head type which is disposed to extend in the width direction (Y axis direction) of the printing medium 95 and is fixed may be included.

The drying unit 27 is provided between the transport rollers 26 and 28. The drying unit 27 dries ink which is discharged on the printing medium 95 and an IR heater is included in the drying unit 27, for example and ink which is discharged on the printing medium 95 can be dried in a short time by driving the IR heater. Accordingly, the printing medium 95 having a strip shape on which an image or the like is formed can be wound around the winding shaft portion 31.

The cleaning unit 50 is disposed between the belt rotating roller 24 and the belt driving roller 25 in the X axis direction. The cleaning unit 50 includes a cleaning portion 51, a pressing portion 52 and a moving portion 53. The moving portion 53 is fixed to a predetermined position by integrally moving the cleaning unit 50 along the floor surface 99.

The pressing portion 52 is a lifting device which is configured as an air cylinder 56 and a ball bushing 57, for example and the cleaning portion 51 which is provided in the upper portion of the pressing portion 52 is in contact with the surface 23*a* of the transport belt 23. The cleaning portion 51 cleans the surface 23*a* (supporting surface) of the transport belt 23, from the lower side (−Z axis direction), which is hung in a state where a predetermined tension is applied between the belt rotating roller 24 and the belt driving roller 25 and is moved from the belt driving roller 25 to the belt rotating roller 24.

The cleaning portion 51 cleans the surface 23*a* of the transport belt 23. The cleaning portion 51 includes a cleaning tank 54 which stores the cleaning liquid 71 (see FIG. 3), a first cleaning roller 81 and a second cleaning roller 82 which are dipped into the cleaning liquid 71 and are in contact with the transport belt 23 to be capable of rotating against the transport belt 23, and a blade 55. In addition, the cleaning portion 51 includes a motor (not illustrated) as a power source which rotates and drives the first cleaning roller 81 and the second cleaning roller 82.

The blade 55 can be made of flexible material such as silicon rubber, for example. The blade 55 is provided in a downstream side of the second cleaning roller 82 in the moving direction of the transport belt 23. By the transport belt 23 and the blade 55 sliding, the cleaning liquid 71 attached to the surface 23*a* of the transport belt 23 is removed by slide of the first cleaning roller 81 and the second cleaning roller 82. Configuration of the first cleaning roller 81, the second cleaning roller 82, and the cleaning tank 54 will be described in detail later.

Electrical Configuration

Figure 2:
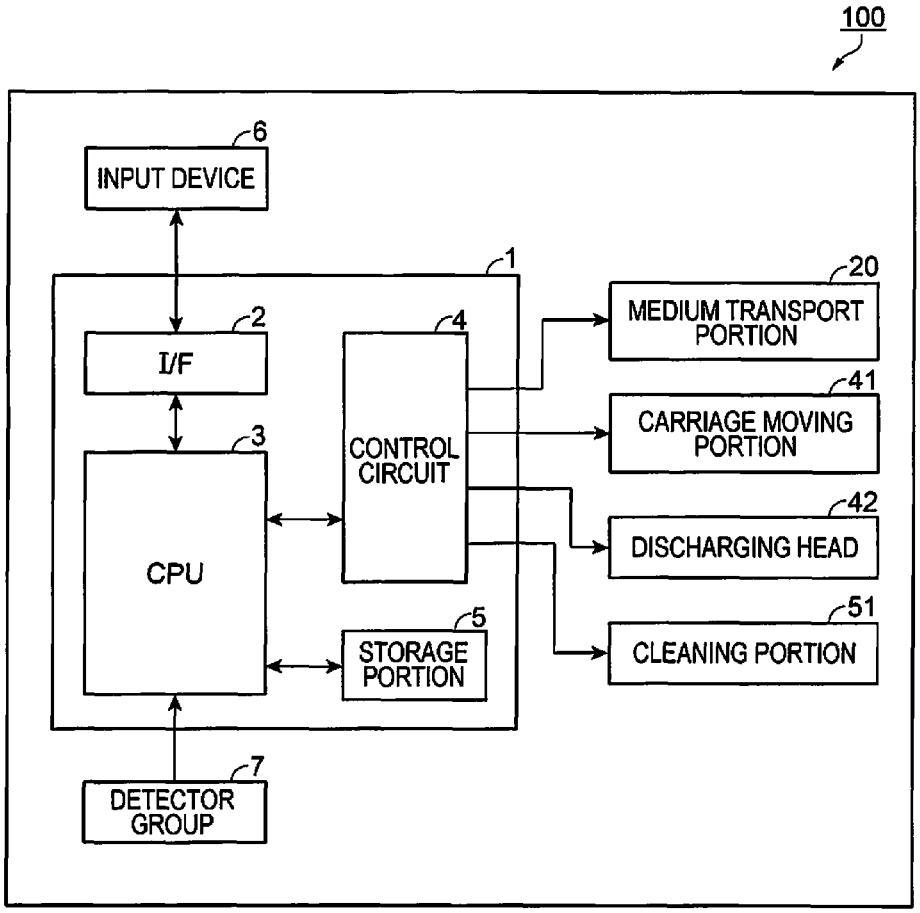
FIG. 2 is an electrical block diagram illustrating electric configuration of the printing apparatus.

FIG. 2 is an electrical block diagram illustrating electric configuration of the printing apparatus. Next, with reference to FIG. 2, the electric configuration of the printing apparatus 100 will be described.

The printing apparatus 100 includes an input device 6 which inputs printing conditions, or the like and a control portion 1 which performs control of each portion of the printing apparatus 100. As the input device 6, desktop or laptop personal computer (PC), tablet devices, portable devices, or the like can be used. The input device 6 may be provided separately from the printing apparatus 100.

The control portion 1 is configured to include a control circuit 4, an interface portion (I/F) 2, a central processing unit (CPU) 3, and a storage portion 5. The interface portion 2 performs sending and receiving of data between the input device 6 which handles input signals and images and the control portion 1. The CPU 3 is an arithmetic processing device for performing input signal processing from various detector group 7 and control of entirety of the printing apparatus 100.

The storage portion 5 ensures area for storing program of the CPU 3, working areas, or the like and includes a storage element such as a random access memory (RAM) and an electrically erasable programmable read-only memory (EEPROM).

The control portion 1 outputs control signals from the control circuit 4 and controls driving of various motors included in the medium transport portion 20 and thus moves the printing medium 95 in the transport direction (+X axis direction). The control portion 1 outputs control signals from the control circuit 4 and controls driving of motor included in the carriage moving portion 41 and thus moves the carriage 43 on which the discharging head 42 is mounted in the width direction (Y direction) of the printing medium 95. The control portion 1 outputs control signals from the control circuit 4 and controls driving of the discharging head 42 and thus discharges ink toward the printing medium 95. The control portion 1 outputs control signals from the control circuit 4 and controls driving of the motor which is provided in the cleaning portion 51 and thus rotates the first cleaning roller 81 and the second cleaning roller 82. In addition, the control portion 1 controls each device which is not illustrated.

The control portion 1 performs printing on the printing medium 95 by repeating main scanning which the carriage 43 (discharging head 42) is moved while ink is discharged from the discharging head 42 by controlling the carriage moving portion 41 and the discharging head 42 and sub scanning in which the printing medium 95 is transported in the transport direction by controlling the medium transport portion 20.

Next, with reference to FIG. 3 to FIG. 5, the first cleaning roller 81, the second cleaning roller 82, and the cleaning tank 54 will be described.

Figure 3:
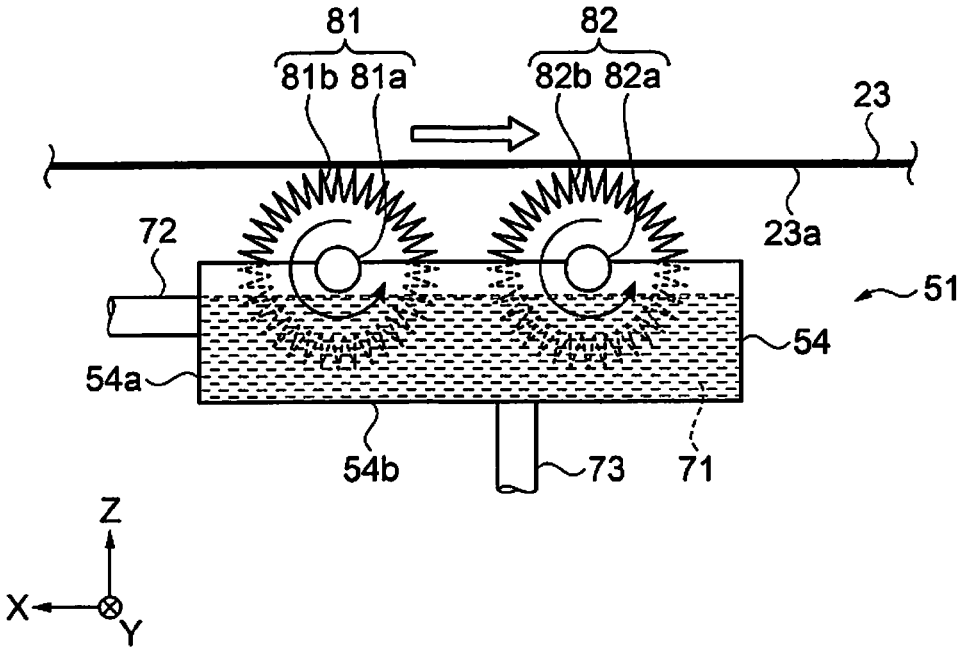
FIG. 3 is a side view illustrating configuration of a cleaning roller and a cleaning tank.

FIG. 3 is a side view illustrating configuration of the cleaning roller and the cleaning tank. FIG. 4 is a plan view illustrating configuration of the cleaning roller and the cleaning tank. FIG. 5 is sectional view at line V-V in FIG. 4. In FIG. 4, for convenience of explanation, the transport belt 23 is made to perspective. In addition, in FIG. 3 and FIG. 4, illustration of the blade 55 which is included in the cleaning portion 51 is omitted.

Figure 4:
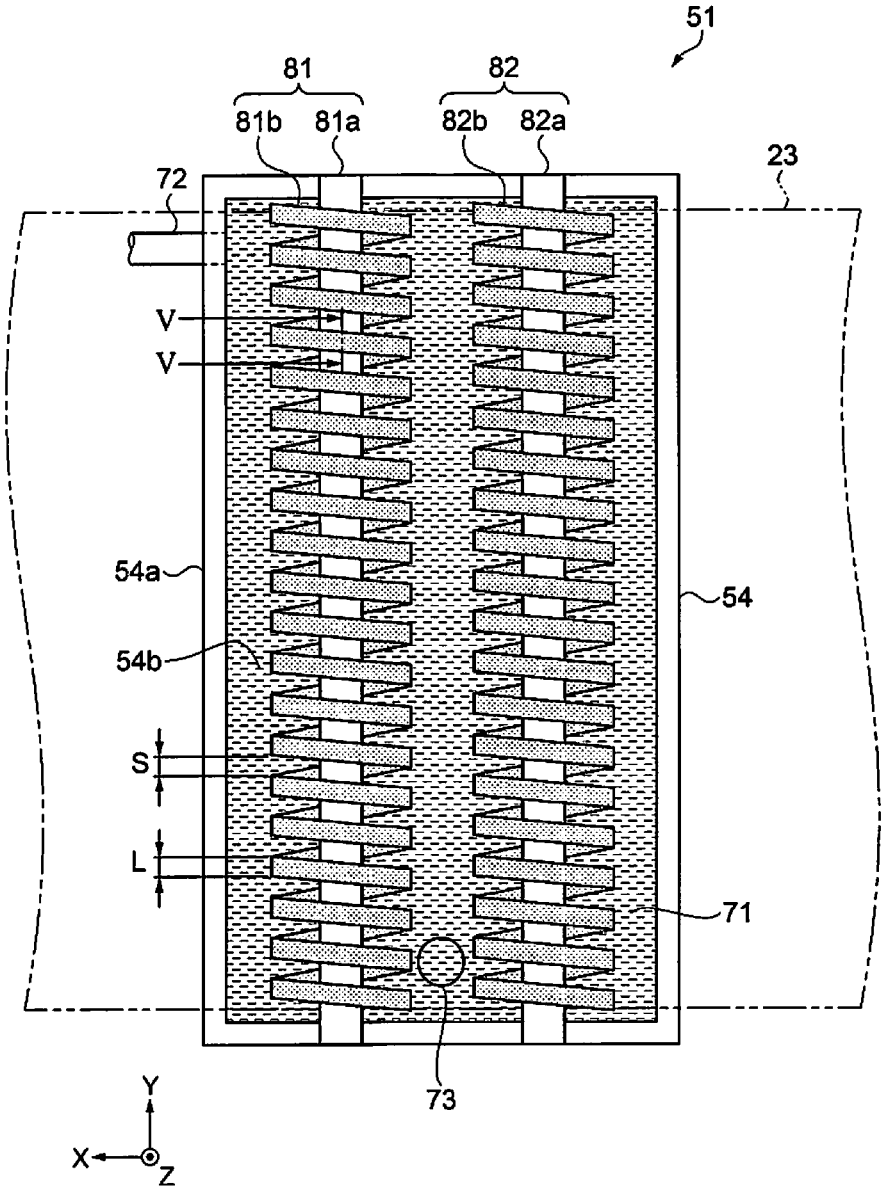
FIG. 4 is a plan view illustrating configuration of the cleaning roller and the cleaning tank.
Figure 5:
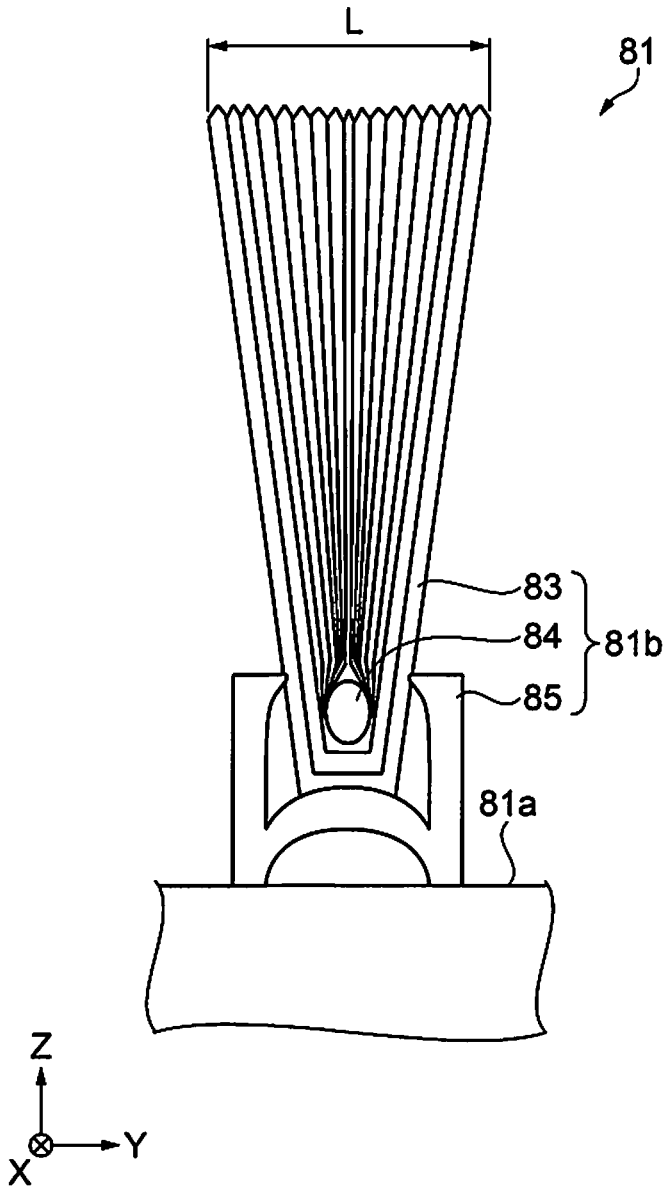
FIG. 5 is sectional view at line V-V in FIG. 4.

As illustrated in FIG. 3 and FIG. 4, the cleaning tank 54 is a rectangular parallelepiped object which includes a long side which is longer than the width of the transport belt 23 in a direction (Y axis direction) intersecting with the moving direction (−X axis direction) thereof and a tank having a concave shape which stores the cleaning liquid 71 for cleaning the surface 23*a* of the transport belt 23. In the cleaning tank 54, a supplying port 72 which supplies the cleaning liquid 71 is provided in the +Y axis side of a side wall 54*a* having a long side in the +X axis side and a discharging port 73 which discharges the cleaning liquid 71 is provided in a center of −Y axis side of a lower surface 54*b*. A plug of the discharging port 73 is opened when an inside of the cleaning tank 54 is cleaned and is closed when the printing is operated. When the printing is operated, the cleaning liquid 71 is supplied from the supplying port 72, the cleaning liquid 71 is stored in the inside of the cleaning tank 54, and the overflowed cleaning liquid 71 is discharged to a buffer tank (not illustrated). As the cleaning liquid 71, for example, water or water-soluble solvent (such as alcohol aqueous solution) can be used and a surfactant and an antifoaming agent may be added therein, if necessary.

A plurality of cleaning rollers (the first cleaning roller 81 and the second cleaning roller 82) are provided in the inside of the cleaning tank 54. The first cleaning roller 81 is provided in the upstream side (+X axis side) and the second cleaning roller 82 is provided in the downstream side (−X axis side) is provided in the moving direction (−X axis side) of the transport belt 23. The first cleaning roller 81 and the second cleaning roller 82 are rotating rollers having widths which are same as the width of the transport belt 23 in a direction (Y axis direction) intersecting with the moving direction (−X axis direction) or have a slightly longer than the width thereof. The first cleaning roller 81 has a rotating shaft 81*a* having a columnar shape which extends in the Y axis direction of the transport belt 23 and the second cleaning roller 82 has a rotating shaft 82*a* having a columnar shape which extends in the Y axis direction of the transport belt 23. Both ends of the rotating shafts 81*a* and 82*a* in the axis direction is supported to be capable of rotating to both side walls having a short side of the cleaning tank 54.

The first cleaning roller 81 includes a spiral brush 81*b* which generates water flow for directing the cleaning liquid 71 in one direction by the rotation of the first cleaning roller 81. The second cleaning roller 82 includes a spiral brush 82*b* which generates water flow for directing the cleaning liquid 71 in one direction by the rotation of the second cleaning roller 82. The brush 81*b* which is included in the first cleaning roller 81 will be described. The brush 82*b* which is included in the second cleaning roller 82 is not described since being same as the brush 81*b* of the first cleaning roller 81.

The brush 81*b* is provided spirally with respect to the rotating shaft 81*a*. Specifically, as illustrated in FIG. 5, the brush 81*b* is configured by a brush bristle 83, a core wire 84, and a channel material 85 having a groove. The brush 81*b* is a strip shape of a channel brush having a brush width L which is formed by a plurality of brush bristles 83 folded into two about the core wire 84 being inserted into the groove of the channel material 85 and the channel material 85 is connected to the rotating shaft 81*a*. The brush bristle 83 is difficult to hair loss and thus durability of the first cleaning roller 81 is improved by using the brush described above to the brush 81*b* of the first cleaning roller 81. Since the configuration of the brush 81*b* described in the embodiment is an example, it is not limited to this.

The brush 81*b* is wound around the rotating shaft 81*a* having a columnar shape as an axial center in the counterclockwise direction in the side view illustrated in FIG. 3 with gaps S being provided from one end of −Y axis side toward the other end of +Y axis side of the rotating shaft 81*a* in the plan view illustrated in FIG. 4. A lower side (−Z axis side) of the brush 81*b* is dipped into the cleaning liquid 71 which is stored in the cleaning tank 54. The gaps S between the brushes 81*b* wound in a spiral shape are set in a size of the entire surface of the surface 23*a* of the transport belt 23 being in contact with the brush 81*b*, based on a rotating velocity of first cleaning roller 81 and a moving distance and moving speed of the transport belt 23 moving when sub scanning.

When the first cleaning roller 81 and the second cleaning roller 82 are rotated in the counterclockwise direction in the side view illustrated in FIG. 3, by a driving control of the control portion 1, fiber of fabric as the printing medium 95, ink, or the like attached to the surface 23*a* of the transport belt 23 is removed by the first cleaning roller 81 and the second cleaning roller 82 containing the cleaning liquid 71 sliding with the transport belt 23. In addition, since the cleaning liquid 71 in the space S of the brushes 81*b* and 82*b* which are provided as a spiral shape is extruded in the −Y axis direction, water flow for directing in one direction from the supplying port 72 to the direction of the discharging port 73 can be generated to the cleaning liquid 71 in the inside of the cleaning tank 54. Momentum of the water flow for directing the cleaning liquid 71 in one direction from the supplying port 72 to the direction of the discharging port 73 can be increased since the plurality of cleaning rollers (the first cleaning roller 81 and the second cleaning roller 82) are included in the printing apparatus 100 according to the embodiment.

The cleaning liquid 71 in which ink is melted or foreign material such as fiber which is dropped out of fabric as a printing medium 95 and an adhesive which is peeled from the transport belt 23 is likely to discharged (overflowed) from the upper of the side wall in the direction of the discharging port 73 of the cleaning tank 54 (−Y axis side) along with the cleaning liquid 71, by the water flow generated in the inside of the cleaning tank 54. The cleaning liquid 71 in the inside of the cleaning tank 54 is purified by new cleaning liquid 71 being poured from the supplying port 72. Accordingly, efficiency of cleaning the transport belt 23 can be improved. In addition, since accumulated material by foreign material which is remained or ink which is precipitated in the inside of the cleaning tank 54 is reduced, frequency of cleaning which is performed by the printing apparatus 100 being stopped for removing the accumulated material can be reduced. In addition, the accumulated material can be easily discharged from the discharging port 73 since the accumulated material is accumulated in the vicinity of the discharging port 73.

In the embodiment, although the printing apparatus 100 in which the two cleaning rollers (the first cleaning roller 81 and the second cleaning roller 82) are included is described as an example, it is not limited to this. The printing apparatus may have one cleaning roller or at least three cleaning rollers.

As described above, according to the printing apparatus 100 related to the embodiment, the following effects can be obtained.

The first cleaning roller 81 and the second cleaning roller 82 may include brushes 81*b* and 82*b* having a spiral shape. The water flow for directing the cleaning liquid 71 in the inside of the cleaning tank 54 in one direction from the supplying port 72 to the direction of the discharging port 73 can be generated by the first cleaning roller 81 and the second cleaning roller 82 in which the brush 81*b* and 82*b* wound in a spiral shape are included being rotated. Accordingly, the cleaning ability of the transport belt 23 can be improved by ink or foreign material being discharged along with the cleaning liquid 71 and thus the cleaning liquid 71 in the inside of the cleaning tank 54 being purified. In addition, the accumulated material such as ink and fiber which is accumulated in the inside of the cleaning tank 54 is reduced and thus frequency of cleaning which is performed by the printing apparatus being stopped in order to remove the accumulated material in the inside of the cleaning tank 54 is reduced. Accordingly, an operating time of the printing apparatus 100 can be longer. Therefore, the printing apparatus 100 can be provided which improves the cleaning ability of the transport belt 23 and production efficiency of the printing apparatus.

Embodiment 2

Figure 6:
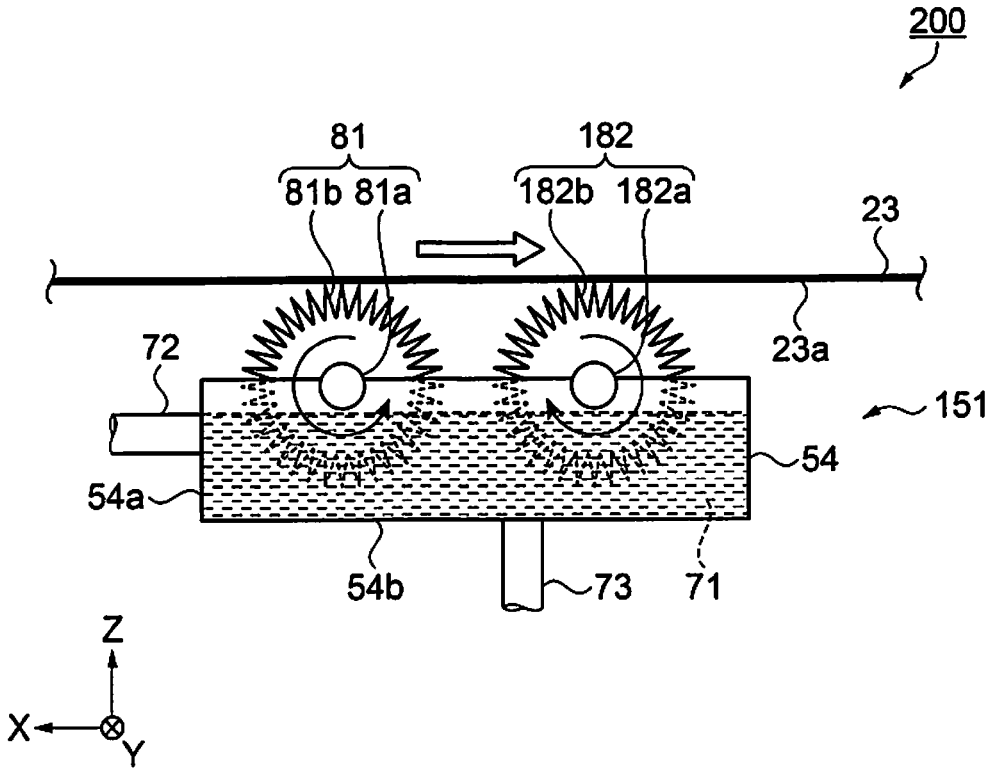
FIG. 6 is a side view illustrating configuration of a cleaning roller and a cleaning tank according to Embodiment 2.
Figure 7:
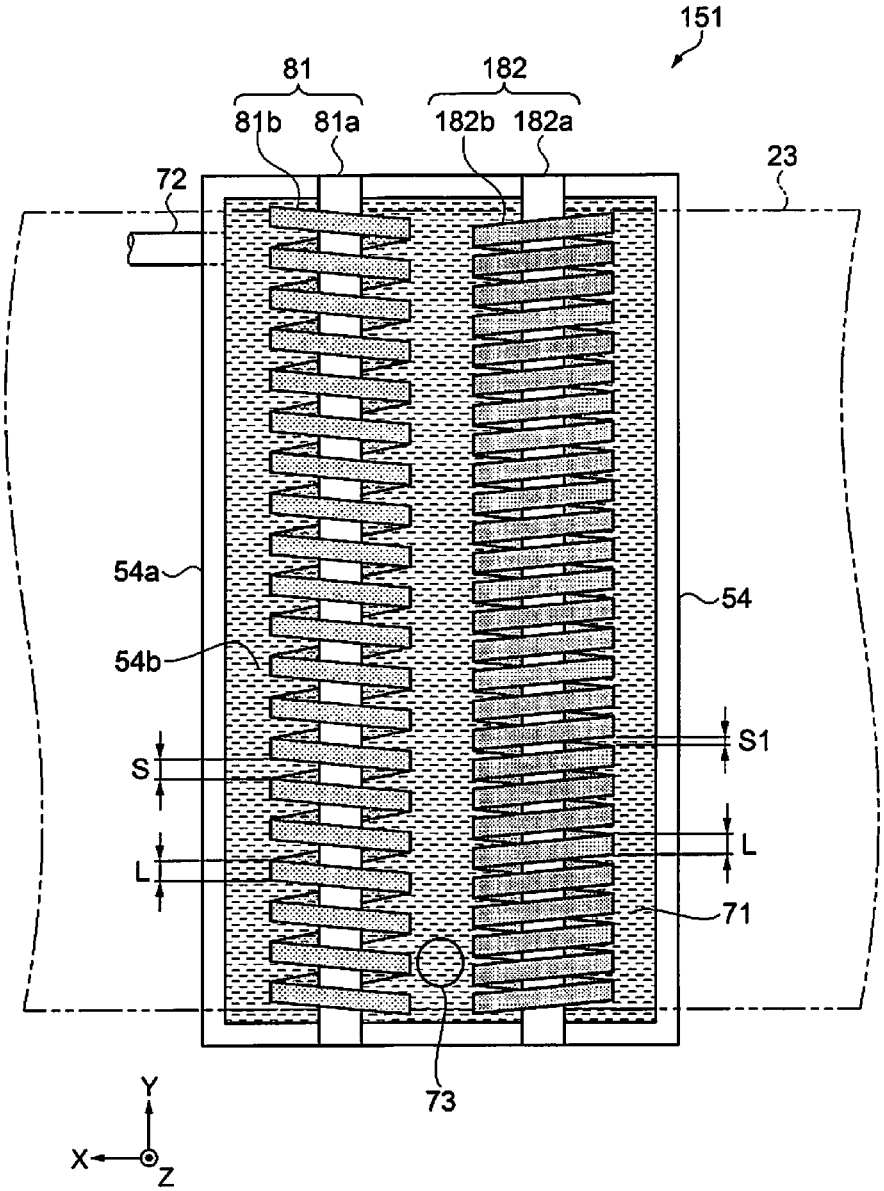
FIG. 7 is a plan view illustrating configuration of the cleaning roller and the cleaning tank.

FIG. 6 is a side view illustrating configuration of a cleaning roller and a cleaning tank according to Embodiment 2. FIG. 7 is a plan view illustrating configuration of the cleaning roller and the cleaning tank. With reference to FIG. 6 and FIG. 7, a printing apparatus 200 of the embodiment will be described. For the same components as in Embodiment 1, the same number is used, and a duplicate description thereof will be omitted. In addition, in FIG. 7, for convenience of explanation, the transport belt 23 is made to perspective.

A cleaning portion 151 cleans the surface 23*a* of a transport belt 23. The cleaning portion 151 includes a cleaning tank 54 which stores a cleaning liquid 71, a first cleaning roller 81 and a second cleaning roller 182 which are dipped into the cleaning liquid 71 and are in contact with the transport belt 23 to be capable of rotating against the transport belt 23, and a blade (not illustrated). In addition, the cleaning portion 151 includes a motor (not illustrated) as a power source which drives and rotates the first cleaning roller 81 and the second cleaning roller 182.

A plurality of cleaning rollers (the first cleaning roller 81 and the second cleaning roller 182) are provided in the inside of the cleaning tank 54. The second cleaning roller 182 is provided in the downstream (−X axis side) is provided in the moving direction (−X axis side) of the transport belt 23. The second cleaning roller 182 is a rotating roller has a width which is same as the width of the transport belt 23 in a direction (Y axis direction) intersecting with the moving direction (−X axis direction) thereof or has a slightly longer than the width thereof. The second cleaning roller 182 has a rotating shaft 182*a* having a columnar shape which extends in the Y axis direction of the transport belt 23. Both ends of a rotating shaft 182*a* in the axis direction are supported to be capable of rotating to both side walls having a short side of the cleaning tank 54.

At least one of the plurality of cleaning rollers has a different winding direction of the brush and a different rotating direction of the cleaning roller. In the embodiment, the winding direction of a brush 182*b* of the second cleaning roller 182 is different from the winding direction of the brush 81*b* of the first cleaning roller 81. In the embodiment, the rotating direction of the second cleaning roller 182 is different from the rotating direction of the first cleaning roller 81. In addition, the winding density of the brush of at least one of the plurality of cleaning rollers becomes dense. In the embodiment, the winding density of the brush 182*b* of the second cleaning roller 182 is denser than the winding density of the brush 81*b* of the first cleaning roller 81.

Specifically, the brush 182*b* of the second cleaning roller 182 is wound around the rotating shaft 182*a* having a columnar shape as an axial center in the clockwise direction in the side view illustrated from −Y axis side in FIG. 6 with gaps S1 being provided from one end of −Y axis side toward the other end of +Y axis side of the rotating shaft 182*a* in the plan view illustrated in FIG. 7. Since a gap S1 of the brush 182*b* is narrower than the gap S of the brush 81*b* of the first cleaning roller 81, winding number of the brush 182*b* which is wound around the second cleaning roller 182 is also more than the winding number of the brush 81*b* which is wound around the first cleaning roller 81. In addition, the first cleaning roller 81 is configured to rotate in the counterclockwise direction and the second cleaning roller 182 is configured to rotate in the clockwise direction, in the side view illustrated from −Y axis side in FIG. 6. A lower side (−Z axis side) of the brush 182*b* is dipped into the cleaning liquid 71 which is stored in the cleaning tank 54.

When the first cleaning roller 81 and the second cleaning roller 182 are rotated, by a driving control of the control portion 1, fiber of fabric as the printing medium 95, ink, or the like attached to the surface 23*a* of the transport belt 23 is removed by the first cleaning roller 81 and the second cleaning roller 182 containing the cleaning liquid 71 sliding with the transport belt 23. Since the brush 182*b* of the second cleaning roller 182 is more densely wound than the first cleaning roller 81, the contact area between the brush 182*b* and the transport belt 23 with each other is wider. Since the second cleaning roller 182 rotates in a direction opposite to the rotating direction of the first cleaning roller 81, the contact area between the first cleaning roller 81, the second cleaning roller 182, and the transport belt 23 with each other is wider. Accordingly, the cleaning efficiency which cleans the transport belt 23 can be improved.

In addition, since the cleaning liquid 71 in the space S1 of the brush 182*b* which is provided as a spiral shape is extruded in the −Y axis direction, water flow for directing in one direction from the supplying port 72 to the direction of the discharging port 73 can be generated to the cleaning liquid 71 in the inside of the cleaning tank 54. Even in a case where the second cleaning roller 182 is rotated in a direction opposite to the rotating direction of the first cleaning roller 81, water flow can be generated in the same direction as the direction of the water flow generated at the first cleaning roller 81 by the winding direction of the brush 182*b* of the second cleaning roller 182 changing to a direction opposite to the winding direction of the brush 81*b* of the first cleaning roller 81.

Accordingly, since momentum of the water flow which is directed in one direction from the supplying port 72 to the direction of the discharging port 73 is increased, the cleaning liquid 71 in which ink is melted or foreign material such as fiber which is dropped out of fabric and an adhesive which is peeled from the transport belt 23 is likely to discharged (overflowed) from the upper of the side wall in the direction of the discharging port 73 of the cleaning tank 54 (−Y axis side) along with the cleaning liquid 71, by the water flow of the cleaning liquid 71. The cleaning liquid 71 in the inside of the cleaning tank 54 is purified by new cleaning liquid 71 being poured from the supplying port 72. Accordingly, the cleaning efficiency of the transport belt 23 can be improved. In addition, since accumulated material by foreign material which is remained or ink which is precipitated in the cleaning tank 54 is reduced, frequency of cleaning which is performed by the printing apparatus 200 being stopped for removing the accumulated material can be reduced.

In the embodiment, although the printing apparatus 200 in which the two cleaning rollers (the first cleaning roller 81 and the second cleaning roller 182) is included is described as an example, the printing apparatus may include at least three cleaning rollers.

As described above, according to the printing apparatus 200 related to the embodiment, the following effects can be obtained.

Since the brush 182*b* of the second cleaning roller 182 is more densely wound than the brush 81*b* of the first cleaning roller 81 and the second cleaning roller 182 is rotated in a direction opposite to the first cleaning roller 81, the contact area between the brush 182*b* and the transport belt 23 with each other is wider. Accordingly, the cleaning efficiency which cleans the transport belt 23 can be improved.

The winding direction of the brush 182*b* of the second cleaning roller 182 and the rotating direction of the second cleaning roller 182 are different from those of the brush 81*b* of the first cleaning roller 81. Even in a case where the second cleaning roller 182 is rotated in a direction opposite to the rotating direction of the first cleaning roller 81, water flow can be generated in the same direction as the direction of the water flow generated at the first cleaning roller 81. Accordingly, cleaning ability of the transport belt 23 can be improved by momentum of the water flow for directing the cleaning liquid 71 from the supplying port 72 to the direction of the discharging port 73 being increased and thus cleaning liquid 71 in the inside of the cleaning tank 54 being purified. In addition, since frequency of cleaning which is performed by the printing apparatus 200 being stopped for removing the accumulated material in the inside of the cleaning tank 54 being reduced, production efficiency of the printing apparatus 200 can be improved.

Embodiment 3

Figure 8:
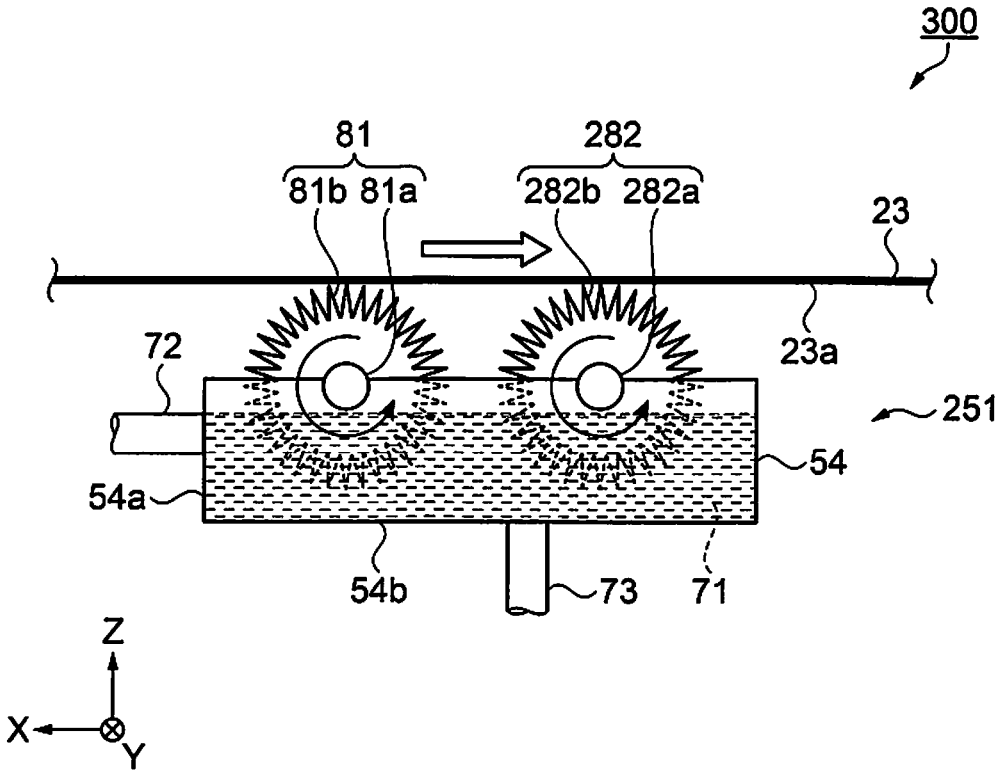
FIG. 8 is a side view illustrating configuration of a cleaning roller and a cleaning tank according to Embodiment 3.
Figure 9:
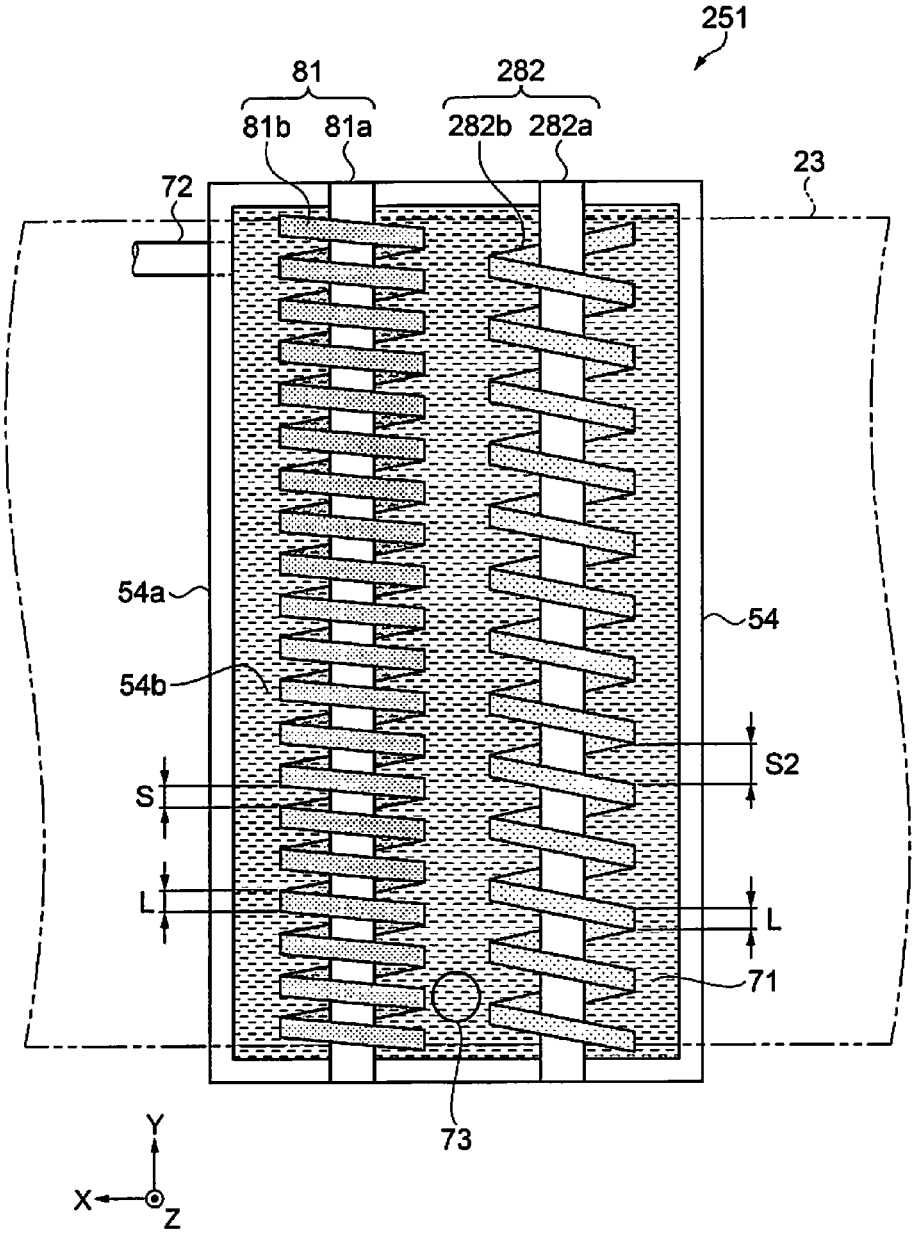
FIG. 9 is a plan view illustrating configuration of the cleaning roller and the cleaning tank.

FIG. 8 is a side view illustrating configuration of a cleaning roller and a cleaning tank according to Embodiment 3. FIG. 9 is a plan view illustrating configuration of the cleaning roller and the cleaning tank. With reference to FIG. 8 and FIG. 9, a printing apparatus 300 of the embodiment will be described. For the same components as in Embodiment 1, the same number is used, and a duplicate description thereof will be omitted. In addition, in FIG. 9, for convenience of explanation, the transport belt 23 is made to perspective.

A cleaning portion 251 cleans a surface 23*a* of a transport belt 23. The cleaning portion 251 includes a cleaning tank 54 which stores the cleaning liquid 71, a first cleaning roller 81 and a second cleaning roller 282 which are dipped into the cleaning liquid 71 and are in contact with the transport belt 23 to be capable of rotating against the transport belt 23, and a blade (not illustrated). In addition, the cleaning portion 251 includes a motor (not illustrated) as a power source which drives and rotates the first cleaning roller 81 and the second cleaning roller 282.

A plurality of cleaning rollers (the first cleaning roller 81 and the second cleaning roller 282) is provided in the inside of the cleaning tank 54. The second cleaning roller 282 is provided in the downstream (−X axis side) is provided in the moving direction (−X axis side) of the transport belt 23. The second cleaning roller 282 is a rotating roller having width which is same as the width of the transport belt 23 in a direction (Y axis direction) intersecting with the moving direction (−X axis direction) or has a slightly longer than the width thereof. The second cleaning roller 282 has a rotating shaft 282*a* having a columnar shape which extends in the Y axis direction of the transport belt 23. Both ends of the rotating shaft 282*a* in the axis direction are supported to be capable of rotating to both side walls having a short side of the cleaning tank 54.

The winding density of the brush of at least one of the plurality of cleaning rollers becomes coarse. In the embodiment, the winding density of a brush 282*b* of the second cleaning roller 282 is coarser than the winding density of the brush 81*b* of the first cleaning roller 81.

Specifically, the brush 282*b* of the second cleaning roller 282 is wound around the rotating shaft 282*a* having a columnar shape as an axial center in a counterclockwise direction in the side view illustrated from −Y axis direction in FIG. 8 with gap S2 being provided from one end of −Y axis side toward the other end of +Y axis side of the rotating shaft 282*a* in the plan view illustrated in FIG. 9. The gap S2 of the brush 182*b* is wider than the gap S of the brush 81*b* of the first cleaning roller 81. In addition, the first cleaning roller 81 and the second cleaning roller 282 are configured to rotate in the counterclockwise direction, in the side view illustrated from −Y axis side in FIG. 8. A lower side (−Z axis side) of the brush 282*b* is dipped into the cleaning liquid 71 which is stored in the cleaning tank 54.

When the first cleaning roller 81 and the second cleaning roller 282 are rotated, by a driving control of the control portion 1, fiber of fabric as the printing medium 95, ink, or the like attached to the surface 23*a* of the transport belt 23 is removed by the first cleaning roller 81 and the second cleaning roller 282 containing the cleaning liquid 71 sliding with the transport belt 23.

The brush 282*b* of the second cleaning roller 282 is more coarsely wound than the brush 81*b* of the first cleaning roller 81 is. In other words, the gap S2 of the brush 282*b* provided in a spiral shape is wider than the gap S of the brush 81*b*. Accordingly, momentum of the water flow which is directed from the supplying port 72 to the direction of the discharging port 73 can be increased by amount of the cleaning liquid 71 which is extruded in the −Y axis direction being increased by the gap S2.

The cleaning liquid 71 in which ink is melted, or foreign material such as fiber which is dropped out of fabric as a printing medium 95 and an adhesive which is peeled from the transport belt 23 is likely to discharged (overflowed) from the upper of the side wall in the direction of the discharging port 73 of the cleaning tank 54 (−Y axis side) along with the cleaning liquid 71, by the water flow of the cleaning liquid 71 of which momentum is increased. Since the cleaning liquid 71 in the inside of the cleaning tank 54 is further purified by new cleaning liquid 71 being poured from the supplying port 72, cleaning ability of the transport belt 23 can be further improved. In addition, the accumulated material of ink or fiber which is accumulated in the inside of the cleaning tank 54 is further reduced and thus frequency of cleaning which is also performed by the printing apparatus 300 being stopped in order to remove the accumulated material in the inside of the cleaning tank 54 can be further reduced.

In the embodiment, although the printing apparatus 300 in which the two cleaning rollers (the first cleaning roller 81 and the second cleaning roller 282) are included is described as an example, the printing apparatus may include at least three cleaning rollers.

As described above, according to the printing apparatus 300 related to the embodiment, the following effects can be obtained.

Momentum of the water flow which is directed from the supplying port 72 to the direction of the discharging port 73 can be increased by amount of the cleaning liquid 71 which is extruded in the −Y axis direction being increased by the gap S2, since the brush 282*b* of the second cleaning roller 282 is coarser than the brush 81*b* of the first cleaning roller 81. Accordingly, cleaning ability of the transport belt 23 can be further improved since the cleaning liquid 71 in the inside of the cleaning tank 54 is further purified. In addition, since frequency of cleaning which is performed by the printing apparatus 300 being stopped for removing the accumulated material in the inside of the cleaning tank 54 is also reduced, production efficiency of the printing apparatus 300 can be further improved.

This application claims priority under 35 U.S.C. § 119 to Japanese Patent Application No. 2016-015311, filed Jan. 29, 2016. The entire disclosure of Japanese Patent Application No. 2016-015311 is hereby incorporated herein by reference.

What is claimed is:

1. A printing apparatus comprising:

a transport belt which transports a printing medium in a transport direction;

a cleaning tank which stores cleaning liquid;

a plurality of cleaning rollers including a cleaning roller which is rotatably dipped in the cleaning liquid and is in contact with the transport belt, the cleaning roller including a shaft that extends in an axial direction, and a spiral brush which generates water flow for directing the cleaning liquid in one direction by the rotation of the cleaning roller, the spiral brush being spirally wounded around the shaft in a winding direction from one end portion of the shaft to an other end portion of the shaft, each of the plurality of cleaning rollers being rotatably dipped in the cleaning liquid, being in contact with the transport belt, and having the spiral brush; and a controller which controls the cleaning roller to rotate so that a rotating direction in which the cleaning roller rotates is the same as the winding direction, as viewed in the axial direction, wherein at least one of the plurality of cleaning rollers, which is different from the cleaning roller, has a different winding direction of the spiral brush, which is different from the winding direction of the spiral brush of the cleaning roller, and has a different rotating direction, which is different from the rotating direction of the cleaning roller.

2. The printing apparatus according to claim 1, wherein the cleaning tank includes a supplying port which supplies the cleaning liquid and a discharging port which discharges the cleaning liquid, and wherein the water flow directs the cleaning liquid from the supplying port to the direction of the discharging port.

3. A printing apparatus comprising:

a transport belt which transports a printing medium in a transport direction;

a cleaning tank which stores cleaning liquid;

a plurality of cleaning rollers including a cleaning roller which is rotatably dipped in the cleaning liquid and is in contact with the transport belt, the cleaning roller including a shaft that extends in an axial direction, and a spiral brush which generates water flow for directing the cleaning liquid in one direction by the rotation of the cleaning roller, the spiral brush being spirally wounded around the shaft in a winding direction from one end portion of the shaft to an other end portion of the shaft, each of the plurality of cleaning rollers being rotatably dipped in the cleaning liquid, being in contact with the transport belt, and having the spiral brush; and a controller which controls the cleaning roller to rotate so that a rotating direction in which the cleaning roller rotates is the same as the winding direction, as viewed in the axial direction, wherein at least one of the plurality of cleaning rollers, which is different from the cleaning roller, has a winding density of the spiral brush that is denser than that of the cleaning roller.

4. A printing apparatus comprising:

a transport belt which transports a printing medium in a transport direction;

a cleaning tank which stores cleaning liquid;

a plurality of cleaning rollers including a cleaning roller which is rotatablv dipped in the cleaning liquid and is in contact with the transport belt, the cleaning roller including a shaft that extends in an axial direction, and a spiral brush which generates water flow for directing the cleaning liquid in one direction by the rotation of the cleaning roller, the spiral brush being spirally wounded around the shaft in a winding direction from one end portion of the shaft to an other end portion of the shaft, each of the plurality of cleaning rollers being rotatably dipped in the cleaning liquid, being in contact with the transport belt, and having the spiral brush; and a controller which controls the cleaning roller to rotate so that a rotating direction in which the cleaning roller rotates is the same as the winding direction, as viewed in the axial direction, wherein at least one of the plurality of cleaning rollers, which is different from the cleaning roller, has a winding density of the spiral brush that is coarser than that of the cleaning roller.

* * * * *